US006378974B1

(12) United States Patent
Oelbrandt et al.

(10) Patent No.: US 6,378,974 B1
(45) Date of Patent: Apr. 30, 2002

(54) INK JET METHOD WITH IMPROVED TONAL RANGE

(75) Inventors: Leo Oelbrandt, Kruibeke; Dirk Quintene, Westerlo; Luc Leenders, Herentals, all of (BE)

(73) Assignee: AGFA-Gevaert

( * ) Notice: Subject to any disclaimer, the term of this patent is extended or adjusted under 35 U.S.C. 154(b) by 0 days.

(21) Appl. No.: 09/387,969

(22) Filed: Sep. 1, 1999

Related U.S. Application Data

(60) Provisional application No. 60/113,325, filed on Dec. 22, 1998.

(30) Foreign Application Priority Data

Sep. 14, 1998 (EP) ..... 98203115

(51) Int. Cl.[7] ..... B41J 2/205
(52) U.S. Cl. ..... 347/15; 347/100; 347/105
(58) Field of Search ..... 347/15, 105, 100, 347/96; 428/195

(56) References Cited

U.S. PATENT DOCUMENTS 5,635,297 A 6/1997 Ogawa et al.
5,885,765 A * 3/1999 Horsten et al. ..... 430/619
5,923,822 A * 7/1999 Takahashi ..... 358/518
6,164,747 A * 12/2000 Yashima et al. ..... 347/15

FOREIGN PATENT DOCUMENTS

| | | | |
|---|---|---|---|
| EP | 0533293 | 3/1993 | |
| EP | 0533293 A1 * | 3/1993 | ..... B41M/5/00 |
| EP | 0600245 | 6/1994 | |
| EP | 0742107 | 11/1996 | |
| EP | 0791475 | 8/1997 | |

* cited by examiner

*Primary Examiner*—John Barlow
*Assistant Examiner*—Manish S. Shah
(74) *Attorney, Agent, or Firm*—Joseph T. Guy; Nexsen Pruet Jacobs & Pollard, LLC

(57) ABSTRACT

A method is disclosed for making on a transparent receiver material a continuous tone image, e.g. for medical diagnostic purposes, with an obtainable maximal transmission density in the visual region greater than 3.0, by means of ink jet. The method comprises ink-jetting combinations of at least one liquid black pigmented ink and at least one liquid grey ink to a transparent receiver comprising an ink receiving layer, a transparent support and a backing layer, said ink receiving layer comprising a N-containing polymer, preferably gelatin, as binder, and being substantially free of particles having an average size larger than 1 $\mu$m. Preferably the transparent receiver exhibits a haze value between 10 and 20%, determined according to standard test ASTM D 1003, due to the presence of a spacing agent in the backing layer.

14 Claims, No Drawings

INK JET METHOD WITH IMPROVED TONAL RANGE

This application is a provisional of No. 60,113,325 filed Dec. 22, 1998.

FIELD OF THE INVENTION

The present invention relates to an ink jet method with improved tonal range and high obtainable maximal density. The method is useful for the rendering of medical diagnostic information.

BACKGROUND OF THE INVENTION

In the majority of applications printing proceeds by pressure contact of an ink-loaden printing form with an ink-receiving material which is usually plain paper. The most frequently used impact printing technique is known as lithographic printing based on the selective acceptance of oleophilic ink on a suitable receptor.

In recent times however so-called non-impact printing systems have replaced classical pressure-contact printing to some extent for specific applications. A survey is given e.g. in the book "Principles of Non Impact Printing" by Jerome L. Johnson (1986), Palatino Press, Irvine, Calif. 92715, USA.

Among non-impact printing techniques ink jet printing has become a popular technique because of its simplicity, convenience and low cost. Especially in those instances where a limited edition of the printed matter is needed ink jet printing has become a technology of choice. A recent survey on progress and trends in ink jet printing technology is given by Hue P. Le in Journal of Imaging Science and Technology Vol. 42 (1), January/February 1998.

In ink jet printing tiny drops of ink fluid are projected directly onto an ink receptor surface without physical contact between the printing device and the receptor. The printing device stores the printing data electronically and controls a mechanism for ejecting the drops image-wise. Early patents on ink jet printers include U.S. Pat. No. 3,739,393, U.S. Pat. No. 3,805,273 and U.S. Pat. No. 3,891,121.

The jetting of the ink droplets can be performed in several different ways. In the early 1960s, Dr. Sweet of Stanford University demonstrated that by applying a pressure wave pattern to an ink stream which is jetted continuously through a small nozzle. This ink stream could be broken in droplets which are uniform in size and spacing. The droplet stream is image-wise divided into droplets that are electrostatically charged and deflected, and into droplets that remain uncharged and continue their way undeflected. This process is known as continuous ink jet printing. In one embodiment the uncharged undeflected droplet stream forms the image while the charged deflected stream is recollected. Alternatively, the charged deflected stream forms the image and the uncharged undeflected jet is recollected. In still a further variant of the latter system several jets are deflected to a different degree and thus record the image (multideflection system). Sweet's invention led to the introductions of A.B. Dick VideoJet and the Mead DIJIT products. In the 1970s IBM licensed the technology and adapted it for their computer printers. At approximately the same time, Prof. Hertz of the Lund Institute of Technology in Sweden and his associates independently developed several continuous ink jet techniques that had the ability to modulate the ink flow characteristics for gray-scale printing by controlling the number of drops deposited in each pixel. This method was licensed to companies such as Iris Graphics/Scitex and Stork to produce high-quality colour images.

As an alternative for continuous ink jet the ink droplets can be created "on demand" ("DOD" or "drop on demand" method) whereby the printing device ejects the droplets only when they are used in imaging on a receiver thereby avoiding the complexity of drop charging and deflection hardware. In drop-on-demand the ink droplet can be formed by means of a piezoelectric transducer (so-called "piezo method"), or by means of discrete thermal pushes (so-called "bubble jet" method, or "thermal jet" method). Zoltan, Kyser and Sears are the pioneers of the first method. In these printers, on the application of voltage pulses, ink drops are ejected by a pressure wave created by the mechanical motion of a piezoelectric ceramic. In 1979, Endo and Hara of Canon Co. invented a drop-on-demand ink jet method wherein ink drops were ejected from a nozzle by the growth and collapse of a water vapor bubble on the top surface of a small heater located near the nozzle. Canon called the technology the bubble jet. During the same time period or shortly thereafter Hewlett-Packard developed a similar ink jet technology, commercialized in 1984 in the Thinkjet printer. They named the technology thermal ink jet.

Ink jet printing technologies are used in a wide range of applications such as desktop publishing at home or at office, industrial printing of packings, e.g. with barcodes, printing of cables, prints from photographs generated from an electronic camera, outdoor advertisement, textile printing; three-dimensional printing, etc. An emerging market is surely ink jet printing of electronically stored medical information. Key players are the companies Scitex/Iris and Sterling Diagnostics. Also Misubishi Plastics recently announced the development of a film that can be imaged with ink jet to print medical images (Japan Chemical Week, (Apr. 9, 1998, p. 1). Hitherto images comprising medical information were conventionally produced by classical photographic techniques. The most commonly used is silver halide technology. After image-wise exposure by X-rays, converted to actinic radiation by means of a phosphor screen, or by a laser beam the film must be processed in baths containing dissolved chemicals. This however is a cumbersome and ecologically undesired procedure. Therefore environmently friendlier materials were recently introduced based on thermographic or photothermographic technologies such as Imation Dryview films and Agfa Drystar. These technologies however need expensive apparatuses based on laser or thermal head imaging. Ink jet could be an inexpensive and ecologically acceptable alternative to the systems mentioned above provided it would be capable of producing continuous tone images with a sufficient number, preferably at least 100, of grey levels, high maximal transmission density, low noise level, and neutral grey tone.

As already mentioned above grey-scale printing can be performed by the Hertz method by controlling the number of droplets deposited in each pixel. A sufficient number of grey levels can also be obtained by combining droplets of different inks having the same colorant but in different concentrations. The principle was already disclosed in U.S. Pat. No. 3,404,221, priority U.S. Pat. No. 22.10.1965. Specific embodiments of the method of combinations of several inks of different densities are disclosed e.g. in DE 3415778, DE 3415775, U.S. Pat. No. 4,533,923, U.S. Pat. No. 4,695,846, U.S. Pat. No. 4,714,964, U.S. Pat. No. 4,686,538, U.S. Pat. No. 4,952,942, U.S. Pat. No. 4,860,026, EP 388978, EP 606022, U.S. Pat. No. 5,606,351, U.S. Pat. No. 5,625,397, and EP 750995. Furtheron grey scale images can be produced by modulation of the ink droplet size as explained in the article "Photo-realistic ink jet printing through dynamic spot size control", by D. Wallace et al., presented at IS & T's Eleventh International Congress on Advances in Non-Impact Printing, Oct. 29–Nov. 3, 1995, Hilton Head, South Carolina. Furtheron combinations of these different methods can be used.

According to the article "Continuous Ink Jet Printing of Medical images" presented at the RSNA congress, November 1993, in Chicago Dr. Philp Drew of Scitex Co. demonstrated the production of multi-grey images by the UniTone ink jet printer based on the combinations of black and grey inks, meaning neutral inks with different colorant concentrations, in combinations with variable dot sizes. These images however were printed on reflective receivers. In this case the reflection density does not increase indefinitly in a linear way as a function of the number of dots per pixel, but becomes almost constant at a density of about 1.6, as explained in the article "Enhanced Density Resolution with Continuous Ink Jet Printing Using Dual Ink Densities" by T. Kirkhorn et al., J. Imag. Sci. Tech., Vol. 36 (1), January/February. 1994, p. 74–80. Therefore the Unitone images cannot be regarded as having the real image quality as required for medical diagnostic imaging.

So far transmission densities higher than 3.0 could only be reached by ink jet printers using so-called hot melt or phase change inks which are solid at ambient temperature. Sterling in cooperation with Tektronix presented the first ink jet system for the production of true medical diagnostic images on transparent receivers at the RSNA congress, November 1996. Hot melt inks however have several disadvantages over the liquid inks. Before printing the inks must be brought in a molten state which takes start-up time and requires a more complex and expensive printer. The produced images look and feel greasy and have a low scratch resistance so that the image can be damaged when handled uncarefully.

In an alternative attempt to reach high densities so-called reactive systems were developed wherein the ink image was enhanced by a silver image obtained by reduction of an organic silver salt, preferably silver behenate, incorporated in the ink composition or in the receiving layer as disclosed in EP 691211 and EP 641670. However these systems are complicated, require a heat treatment and are therefore commercially unattractive.

OBJECTS OF THE INVENTION

It is an object of the present invention to provide an ink jet printing method, particularly suited for reproduction of medical diagnostic information, which is capable to produce maximal densities higher than 3.0.

It is a further object of the present invention to provide an ink jet printing method that reaches the goal mentioned above by using conventional liquid inks.

SUMMARY OF THE INVENTION

The objects of the present invention are realized by providing a method comprising ink-jetting combinations of at least one liquid black pigmented ink and at least one liquid grey ink to a receiver material comprising an ink receiving layer, a transparent support and a backing layer, said ink receiving layer comprising at least one N-containing polymer, and being substantially free of particles having an average size larger than 1 $\mu$m The N-containing polymer present as binder in the ink receiving layer is preferably gelatin.

In a preferred embodiment the receiver material exhibits a haze value between 10 and 20%, determined according to standard test ASTM D 1003, due to the presence of a spacing agent in the backing layer.

DETAILED DESCRIPTION OF THE INVENTION

Description of the Receiver Material

The receiving layer of the receiver material of the present invention may consist of just one single layer or can be coated as a multiple layer pack, e.g. a double layer. The receiving layer or layer pack comprises as main ingredients a binder which is a N-containing polymer. Farout the most preferred binder is gelatin. The advantages of gelatin are the facts that it forms a clear coating, is readily cross-linked in an easily controllable manner, and is highly absorptive of water-based liquid inks thereby providing rapid drying characteristics. Other N-containing binders can be chosen from a large variety of chemical compounds including e.g. polyvinyl pyrrolidone (PVP), polyacrylamide, acrylamide/acrylic acid, poly(2-acrylamido-2-methyl propane sulphonic acid), poly(diethylene triamine-co-adipic acid), polyvinyl pyridine, polyvinyl imidazole, quaternized polyimidazoline, polyethylene imine epichlorohydrine modified, ethoxylated polyethylene imine, poly(N,N,-dimethyl-3,5-dimethylene piperidinium chloride, polyurethene, melamin resins, urea resins, nitrile rubbers, albumin.

More than one N-containing polymer can be present in the receiving layer. In a preferred embodiment gelatin is mixed with polyvinyl pyrrolidone (PVP).

In principle, although not being a preferred embodiment, a non-N-containing binder may also be present in the receiving layer, e.g. cellulose derivatives such as hydroxyethyl cellulose, hydroxypropyl cellulose, hydroxypropyl methyl cellulose; starch, dextran; polyvinyl alcohol, polyvinyl acetate, polyvinyl acetal, polyalkyleneoxides, film-forming latices such as copoly(styrene-butadiene), carboxylated polymers, polyacrylates, etc.

The receiving layer can further contain fillers, pigments, whitening agents and porous particulate material for as far as these compounds have an average particle size smaller the 1 $\mu$m. By setting this upper limit to the average particle size it is made sure that these compounds cannot be regarded as matting or spacing agents and that they do not decrease the transmission density of the ink applied. Inorganic materials include e.g. synthetic silica, talc, clay, koalin, diatomaceous earth, calcium carbonate, magnesium carbonate, aluminium hydroxide, aluminium oxide, boehmite and pseudo-boehmite, titanium oxide, zinc oxide, barium sulfate, calcium sulfate, zinc sulfide, satin white, aluminium silicate, calcium silicate, lithopone, etc. Organic materials (with the same particle size limitation) include e.g. polystyrene, polymethacrylate, polymethylmethacrylate, elastomers, ethylene-vinylacetate copolymers, polyesters, polyester-copolymers, polyacrylates polyvinylethers, polyamides, polyolefines, polysilicones, guanamine resins, polytetrafluoroethylenes, elastomeric styrene-butadiene rubber (SBR), elastomeric butadiene-acrylonitrile rubber, urea resins, urea-formalin resins, etc. Pigments and particles have also been described in patent applications DE 2,925,769, GB 2,050,866, U.S. Pat. No. 4,474,850, U.S. Pat. No. 4,547,405, U.S. Pat. No. 4,578,285, WO 88 06532, U.S. Pat. No. 4,849,286, EP 339 604, EP 400 681, EP 407 881, EP 411 638 and U.S. Pat. No. 5,045,864.

Again, the presence of modifications of these compounds with an average particle size higher than 1 $\mu$m is excluded from the scope of the invention.

Further typical and useful ingredients of ink jet receiver layers are so-called mordanting agents which by fixing the colorant of the jetted ink composition strongly improve the waterfastness of the finished image. Such mordant are usually (co)polymers containing cationic functions such as quaternary ammonium groups, fosfonium, sulfonium, and guadinium groups. Examples of such disclosures include U.S. Pat. No. 4,371,582, U.S. Pat. No. 4,575,465, U.S. Pat. No. 4,649,064, GB 2210071, EP 423829, DE 3109931, U.S. Pat. No. 4,585,724, EP 295338, EP 306564, U.S. Pat. No. 5,314,747, EP 609930, WO 94/20304, WO 94/20305, WO 94/20306, EP 615853, EP 615884, EP 618214, Also inorganic mordants have been described e.g. in U.S. Pat. No. 5,560,996, EP 704316, EP 754560.

The ink receiving layer according to this invention may be cross-linked to provide such desired features as waterfastness and non-blocking characteristics. The cross-linking is also useful in providing abrasion resistance and resistance to the formation of fingerprints on the element as a result of handling. There are a vast number of known cross-linking agents, also known as hardening agents that can be used individually or in combination and in free or in blocked form. Useful hardeners include formaldehyde and free dialdehydes, such as succinaldehyde and glutaraldehyde, blocked dialdehydes, active esters, sulfonate esters, active halogen compounds, s-triazines and diazines, epoxides, active olefins having two or more active bonds, active olefins, carbodiimides, isoxazolium salts unsubsituted in the 3-position, esters of 2-alkoxy-N-carboxy-dihydro-quinoline, N-carbamoyl and N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly (acroleinmethacrylic acid).

The ink-receiving layer of the present invention can also comprise a plasticizer such as ethylene glycol, dietylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, N-methyl-2-pyrrolidone, N-vinyl-2-pyrrolidone, and polymer latices with low Tg value such as polyethylacrylate, polymethylacrylate, etc.

Surfactants may be incorporated in the ink-receptive layer of the present invention. They can be any of the cationic, anionic, amphoteric, and nonionic ones as described in JP-A 62–280068 (1987). Examples of the surfactants are N-alkylamino acid salts, alkylether carboxylic acid salts, acylated peptides, alkylsulfonic acid salts, alkylbenzene and alkylnaphthalene sulfonic acid salts, sulfosuccinic acid salts, olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylformaldehyde condensed polyoxyethylene ethers, blocked polymers having polyoxypropylene, polyoxyethylene polyoxypropylalkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro $C_2$–$C_{10}$ alkylcarboxylic acids, disodium N-perfluorooctanesulfonyl glutamate, sodium 3-(fluoro-$C_6$–$C_{11}$-alkyloxy)-1-$C_3$–$C_4$ alkyl sulfonates, N-[3-(perfluorooctanesulfonamide)-propyl]-N, N-dimethyl-N-carboxymethylene ammonium betaine, fluoro-$C_{11}$–$C_{20}$ alkylcarboxylic acids, perfluoro $C_7$–$C_{13}$ alkyl carboxylic acids, perfluorooctane sulfonic acid diethanolamide, Li, K and Na perfluoro $C_4$–$C_{12}$ alkyl sulfonates, N-propyl-N-(2-hydroxyethyl)perfluorooctane sulfonamide, perfluoro $C_6$–$C_{10}$ alkylsulfonamide propyl sulfonyl glycinates, bis-(N-perfluorooctylsulfonyl-N-ethanolaminoethyl)phosphonate, mono-perfluoro $C_6$–$C_{16}$ alkyl-ethyl phosphonates, and perfluoroalkylbetaine.

The image-receiving layers of the present invention may additionally comprise additives which are well known in the art, such as UV-absorbers, e.g. as disclosed in e.g. U.S. Pat. No. 4,926,190, antistatic agents, and others.

Description of the Support of the Receiving Material

Useful transparent organic resin supports include e.g. cellulose nitrate film, cellulose acetate film, polyvinylacetal film, polystyrene film, polyethylene terephthalate film, polycarbonate film, polyvinylchloride film or poly-α-olefin films such as polyethylene or polypropylene film. The thickness of such organic resin film is preferably comprised between 0.05 and 0.35 mm. In a most preferred embodiment of the present invention the support is a polyethylene terephthalate film provided with at least one subbing layer. This subbing layer can be applied before or after stretching of the polyester film support. The polyester film support is preferably biaxially stretched at an elevated temperature of e.g. 70–120° C., reducing its thickness by about ½ to ⅙ or more and increasing its area 2 to 9 times. The stretching may be accomplished in two stages, transversal and longitudinal in either order or simultaneously. The subbing layer, when present, is preferably applied by aqueous coating between the longitudinal and transversal stretch, in a thickness of 0.1 to 5 mm. This subbing layer preferably contains a homopolymer or copolymer of a monomer comprising covalently bound chlorine. Examples of said homopolymers or copolymers suitable for use in the subbing layer are e.g. polyvinyl chloride, polyvinylidene chloride, a copolymer of vinylidene chloride, an acrylic ester and itaconic acid, a copolymer of vinyl chloride and vinylidene chloride, a copolymer of vinyl chloride and vinyl acetate, a copolymer of butylacrylate, vinyl acetate and vinyl chloride or vinylidene chloride, a copolymer of vinyl chloride, vinylidene chloride and itaconic acid, a copolymer of vinyl chloride, vinyl acetate and vinyl alcohol etc. Polymers that are water dispersable are preferred since they allow aqueous coating of the subbing layer which is ecologically advantageous.

A second subbing layer may be present which is usually more hydrophilic and contains e.g. gelatin and an adhesion promoting polymer.

The polyester support can be blue coloured as it is also often the case with silver halide medical imaging films.

The support may be a mono-component layer or can consist of blend, or of a laminate of different materials manufactured by means of coextrusion.

Description of the Backing Layer of the Receiving Material

In a most preferred embodiment of the present invention the receiving element exhibits a haze value between 10 and 20% which is desirable for the visual interpretation of the final continuous tone image, particlarly when this image is the reproduction of medical diagnostic information. The haze value is determined according to standard test ASTM D 1003. This is preferably realized by the incorporation of a spacing agent in the backing layer. The term "spacing agent" should be interpreted in its broad sense and as being equivalent to "matting agent" and "roughening agent". The presence of the spacing agent improves the transport in the printer, avoides the sticking of sheets to each other, and prevents the rubbing-off of the ink jet image or the transfer of a previously printed image.

The nature of the matting particles present in the backing layer is not limited to a specific chemical type but can be chosen from a wide variety of chemical classes and commercial products as revealed in scientific and patent literature from the ink jet field itself or from other imaging technologies such as silver halide photography. Useful roughening agents include following:

- different types of silica such as disclosed e.g. in U.S. Pat. No. 3,084,131, U.S. Pat. No. 4,892,591, U.S. Pat. No. 4,902,568, EP 379964, EP 423829, U.S. Pat. No. 5,165,973, EP 739747, EP 781666, EP 803374, EP 862510, Wo 97/20691
- starch or modified starch particles such as disclosed in EP 445327, EP 480362, EP 524635;
- the spherical polymeric beads disclosed in U.S. Pat. No. 4,861,818
- the alkali-soluble beads of U.S. Pat. No. 4,906,560 and EP 0 584 407
- the insoluble polymeric beads disclosed in EP 0 466 982
- polymethylmethacrylate beads;
- copolymers of methacrylic acid with methyl- or ethylmethacrylate;
- TOSPEARL siloxane particles (e.g. types T105, T108, T103, T120), marketed by Toshiba Co;
- SEAHOSTAR polysiloxane—silica particles (e.g. type KE-P50), marketed by Nippon Shokubai Co;
- EPOSOAR MA particles;,these are polymethylmethacrylate (PMMMA) X-linked (e.g. MA 1002, MA 1004);
- SOKEN PEARL: spherical PMMMA micro powders (AS series :e.g. AS 15, 22, 30, 50, 65);
- ROPAQUE particles, being polymeric hollow spherical core/sheat beads, marketed by Rohm and Haas Co, and described e.g. is US-P's 4,427,836, 4,468,498 and 4,469,825;
- ABD PULVER, marketed by BASF AG
- CHEMIPEARL, spherical poymeric particles, marketed by Misui Petrochemical Industries, Ltd.;
- particles coated with a water-repellent material such as disclosed in U.S. Pat. No. 5,204,233;
- polymer particles having a reactive functional group capable of forming a covalent bond with a hardener or a binder, as disclosed in U.S. Pat. No. 5,057,407;
- fluorine containing polymer pearls as described in EP 281928;
- polymer particles prepared by suspension polymerisation as described e.g. in U.S. Pat. No. 5,342,733;
- particles containing two polymers prepared as described by the method of EP 399729;
- polystyrene beads prepared as disclosed in EP 341200;
- gelatin-grafted polymer matting agents according to EP 307855.

The presence of a matting agent in the backing layer itself of an ink jet receiving material is disclosed in e.g.:

- JP-A 7-179025: backing layer contains spherical particles having an average size of 5-15 $\mu$m, e.g. spherical polystyrene particles of 5 $\mu$m;
- U.S. Pat. No. 5,190,805 and corresponding EP 533293, and U.S. Pat. No. 5,206,071 and corresponding EP 545470 disclose specific receiver materials with a coarse matting agent in the backing layer.

A preferred type of matting agent is a hydrophobic modified starch. An example of such a modified starch is commercialized under the trade name "DRY FLO" by Roquette National Chimie. It is a starch ester containing hydrophobic groups. Its average particle diameter (median) according to volume is comprised between 13 and 20 $\mu$m.

The backing layer may further contain essentially the same ingredients as the receiving layer.

Description of the Ink Compositions

Ink compositions for ink jet typically include following ingredients: dyes or pigments, water and/or organic solvents, humectants such as glycols, detergents, thickeners. polymeric binders, preservatives, etc. It will be readily understood that the optimal composition of such an ink is dependent on the ink jetting method used and on the nature of the substrate to be printed. The ink compositions can be roughly divided in:

- water based; the drying mechanism involves absorption, penetration and evaporation;
- oil based; the drying involves absorption and penetration;
- solvent based; the drying mechanism involves evaporation;
- hot melt or phase change: the ink vehicle is liquid at the ejection temperature but solid at room temperature; drying is replaced by solidification;
- radiation curable, e.g. UV-curable; drying is replaced by polymerization.

It will be readily understood that the first three types of ink compositions require a receiving medium that is more or less absorptive. On the contrary, for non-absorbent substrates hot melt inks or radiation-curable inks will be better suited.

According to the present invention combinations of liquid inks, preferably water-based inks are used. Hot melt inks are explicitly excluded.

Early patents on water-based inks include U.S. Pat. No. 3,903,034, U.S. Pat. No. 3,889,269, U.S. Pat. No. 3,870,528, U.S. Pat. No. 3,846,141, U.S. Pat. No. 3,776,742 and U.S. Pat. No. 3,705,043.

Typically water-based inks contain about 75–90 weight % of water. In order to avoid dry tipping on the orifice they contain a so-called humectant or mixtures of humectants which usually are (poly)alcohols. Suitable humectants include glycols such as diethyleneglycol, glycerine and polyethyleneglycol, N-methyl-pyrrolidone, 2-pyrrolidone, N-methyl-2-pyrrolidone, isopropanol, and 1,2-dimethyl-2-imidazolidone. Certain humectants such as N-methylpyrrolidone and 2-pyrrolidone have been found to improve the solubility of the colorant in the ink and thus serve the dual role as humectant and as cosolvent. Typically these humectants are present in a concentration ranging from 5 to 15%.

Apart from the colorant, water and humectant water-based ink compositions may contain in minor amounts further ingredients such as surfactants, biocides, buffering agents, chelating agents and defoaming agents.

It is essential that one of the ink compositions used in the process of the present invention is a concentrated black pigmented ink. Preferably the black pigment is carbon black in a concentration of at least 2%, preferably about 5%. Multiple types of inks containing carbon black are commercially available. Examples of useful carbon blacks include Regal 400R, Mogul L, Elftex 320 from Cabot Co., or Cardon Black IW18, Special Black 250, Special Black 350, Special Black 550, Printex 25, Printex 35, Printex 55, Printex 150T from Degussa Co., and Pigment Black 7.

According to the present invention combinations are jetted to the receiver of this concentrated black ink and at least one other grey ink. A grey ink is defined as an ink capable of producing a lower density than the black ink under identical printing conditions. The grey ink(s) can be simply (a) dilution(s) of the concentrated black ink. The ratios of the concentrations of the different inks must be chosen so that in combination with the print method used a linear tone rendering can be obtained over the whole printable density range. The linearisation of the visual perception curve must be taken into account. The ratios chosen are also function of the maximal number of overlapping droplets per dot. Furtheron, the screening algorithm may play a role in the choice of the optimal ratios.

Alternatively, the diluted grey inks can be compositions containing a mixture of a cyan colorant, a magenta colorant and a yellow colorant in such a ratio that again a grey ink is obtained. However, this is not the preferred option since it is difficult with a mixture of colorants to obtain a neutral hue over the whole tonal range due to their spectral side absorptions.

The colorants can be pigments or dyes.

Suitable pigments include, for instance, C. I. Pigment Yellow 17, C. I. Pigment Blue 27, C. I. Pigment Red 49:2, C. I. Pigment Red 81:1, C. I. Pigment Red 81:3, C. I. Pigment Red 81:x, C. I. Pigment Yellow 83, C. I. Pigment Red 57:1, C. I. Pigment Red 49:1, C. I. Pigment Violet 23, C. I. Pigment Green 7, C. I. Pigment Blue 61, C. I. Pigment Red 48:1, C. I. Pigment Red 52:1, C. I. Pigment Violet 1, C. I. Pigment White 6, C. I. Pigment Blue 15, C. I. Pigment Yellow 12, C. I. Pigment Blue 56, C. I. Pigment Orange 5, C. I. Pigment Black 7, C. I. Pigment Yellow 14, C. I. Pigment Red 48:2, C. I. Pigment Blue 15:3, C. I. Pigment Yellow 1, C. I. Pigment Yellow 3, C. I. Pigment Yellow 13, C. I. Pigment Orange 16, C. I. Pigment Yellow 55, C. I. Pigment Red 41, C. I. Pigment Orange 34, C. I. Pigment Blue 62, C. I. Pigment Red 22, C. I. Pigment Red 170, C. I. Pigment Red 88, C. I. Pigment Yellow 151, C. I. Pigment Red 184, C. I. Pigment Blue 1:2, C. I. Pigment Red 3, C. I. Pigment Blue 15:1, C. I. Pigment Red 23, C. I. Pigment Red 112, C. I. Pigment Yellow 126, C. I. Pigment Red 169, C. I. Pigment Orange 13, C. I. Pigment Red 1–10, 12, C.I. Pigment Blue 1:X, C.I. Pigment Yellow 42, C.I. Pigment Red 101, C.I. Pigment Brown 6, C.I. Pigment Brown 7, C. I. Pigment Brown 7:X, C.I. Pigment Black 11, C.I. Pigment Metal 1, or C.I. Pigment Metal 2.

Furtheron the pigment may be chosen from those disclosed in Industrial Organic Pigments, Production, Properties, Applications, second edition, W. Herbst, K. Hunger; VCH, 1997. Additional examples of suitable pigments are disclosed in, for example, U.S. Pat. No. 5,389,133 and U.S. Pat. No. 5,713,988.

The pigment particles should be sufficiently small to permit free flow of the ink through the ink jet printing device, especially at the ejecting nozzles that usually have a diameter ranging from less than 10 microns to 50 microns. The pigment particle size also has an influence on the pigment dispersion stability, which is critical throughout the life of the ink. It is also desirable to use small particles for maximum color strength.

Accordingly, the average particle diameter may be from about 0.005 μm to about 15 μm. Preferably, the pigment particle size may range from about 0.005 to about 5 μm, more preferably from about 0.005 to about 1 μm, and most preferably from about 0.005 to about 0.3 μm. Pigment particle sizes outside these ranges may, of course, be used as long as the objectives of the present invention are achieved.

Very fine dispersions of pigments and methods for their preparation are disclosed in e.g. EP 0 776 952, U.S. Pat. No. 5,538,548, U.S. Pat. No. 5,443,628, EP 0 259 130, U.S. Pat. No. 5,285,064, EP 0 429 828, and EP 0 526 198.

Suitable dyes include e.g. Orasol Pink 5BLG, Blue 2GLN, Red G, Yellow 2GLN, Blue GN, Blue BLN, Brown CR, Neolan Blue, all available from Ciba-Geigy Co.; Morfast Blue 100, Red 101, Red 104, Yellow 102, all available from Morton Chemical Co, Ajax, Ontario; Bismark Brown R, available from Aldrich; Savinyl Yellow RLS, Red 3 GLS, Pink GBLS, all available from Sandoz Co.

Apart from the use of combinations of differently concentrated inks the grey scale reproduction method according to the present invention can make use of multiple dot printing onto one pixel, and/or of dot size modulation, as mentioned in the Background section. Also combinations of the foregoing methods can be used.

It will be clear that the essential medical information is recorded in neutral grey, but, in principle, so-called spot colours can be added to the image at particular parts.

The present invention will now be illustrated by the following examples without however being limited thereto.

EXAMPLES

Example 1

This example shows that when jetting pigmented ink to a receiver used in accordance with the present invention visual densities higher than 3.0 can be reached.

The following receiver elements were prepared (see also table 1).

Invention Receiver 1

Layer 1 and 3 (table 1) were coated together using a slide hopper coater. The first layer had a wet coating thickness of 100 μm, the second 20 μm. The layers were dried at 50° C.

Comparison Receiver 1

Layer 1 and 2 were coated together using a slide hopper coater. The spacing agent DRY FLO, being a modified starch was present in layer 2. The first layer had a wet coating thickness of 100 μm, the second 20 μm. The layers were dried at 50° C.

Comparison Receiver 2

Layer 4 was coated using a slide hopper coater. No N-containing 15 polymer was present as binder; instead of it a commercial polyvinyl alcohol type (Mowiol) was used. The layer had a wet coating thickness of 100 μm, and was dried at 50° C.

TABLE 1 layer compositions; the mixtures were diluted with water up to 1 liter

| Product (concentration wt %) | layer 1 | layer 2 | layer 3 | layer 4 |
|---|---|---|---|---|
| gelatine K16096 Koepf | 54 g | 45 g | 45 g | / |
| polyvinylpyrrolidone K90 (5%) BASF | 272 | 224 ml | 224 ml | / |

TABLE 1-continued layer compositions; the mixtures were diluted with water up to 1 liter

| Product (concentration wt %) | layer 1 | layer 2 | layer 3 | layer 4 |
|---|---|---|---|---|
| Akypo RO 90 (5%) Roland | / | 10 ml | 10 ml | 15 ml |
| Fluorad FX1005 (5%) 3M | / | 1 ml | 1 ml | / |
| modified starch beads (15$\mu$ mean particle size) (20%) | / | 25 ml | / | / |
| Mowiol 10 74 (10%) Hoechst | / | / | / | 800 ml |

The different ink-jet receiving layers were coated on a subbed polyester substrate. Ink jet printing (full areas) was performed with following printers respectively: HP850 (pigmented black ink), Epson 800 (black mixture of dyes) and Canon 610 (black mixture of dyes) in a 50% RH room at ambient temperature. The optical density measured on a MacBeth TR924 (visual) was measured after 1 day of printing.

TABLE 2 visuai density of the black ink measured using a Macbeth TR924 for different ink jet receiver layers on transparant PET 100$\mu$.

| | HP850C | Epson 800 | Canon 610 |
|---|---|---|---|
| Receiver 1 | 3.7 | 1.55 | 2.4 |
| Comparison 1 | 2.7 | 1.55 | 2.4 |
| Comparison 2 | 0.21 | 2 | 2.4 |

Conclusions

The table shows that only the sample printed with the pigmented ink of HP850C gives an optical density (VIS) higher than 3. After printing with black dyes like with Epson 800 and Canon 610, the optical density is lower than 3.0

The results also show that printing with a pigmented black ink (HP850C) on a ink jet receiver containing a spacing agent with a high average particle size results in a lowering of the $OD_{VIS}$ under 3.0.

The results also show that printing with a pigmented black ink (HP850C) on a receiver containing a non-N-containing polymer as binder the $OD_{VIS}$ is very low and no longer within the specification.

Example 2

This example illustrates how continuous tone images with good image quality can be obtained by the method of the present invention.

Receiver 1 from example 1 was printed with an HP890 printer by means of a combination of following inks:

Concentrated black ink: 76.5% of water, 8.5% of 2-pyrrolidone, 1.5% of propanol, 8.3% of polyethyleneglycol (MW 1417), and 5% of carbon black.

Grey inks: 5× and 12× dilutions of the black ink respectively.

Method of Printing

Digitally stored medical diagnostic information was loaded in from a medical scanner into a personal computer. Via Adobe Photoshop the continuous tone image information was splitted up by means of appropriate software into the three colour channels CMY whereby its channel was splitted up into 256 driving levels, according to following scheme:

lightest 33% of grey levels: cyan channel;

medium 33% of grey levels: yellow channel;

darkest 33% of grey levels: magent channel.

Then the ink cassettes of a HP890 were loaded with the three inks described above according to following scheme and installed in the printer:

cassette of the magenta channel: black concentrated ink;

cassette of the yellow channel: 5× diluted grey ink;

cassette of the cyan channel: 12× diluted grey ink.

The image information was printed on invention receiver 1 of example

1. The following image characteristics were obtained:

Dmax (vis): 3.6–4.5 image hue: neutral image quality: good quality full area: good

What is claimed is:

1. A method for making by means of ink jet on a transparent receiver a continuous tone image with an obtainable maximal transmission density in the visual region greater than 3.0, by ink-jetting combinations of at least one liquid black pigmented ink and at least one liquid grey ink to a transparent receiver comprising an ink receiving layer, a transparent support and a backing layer, said ink receiving layer comprising at least one N-containing polymer and being substantially free of particles having an average particle size larger than 1 $\mu$m.

2. A method according to claim 1 wherein said receiver exhibits a haze value between 10 and 20%, determined according to standard test ASTM D 1003.

3. A method according to claim 2 wherein said haze value between 10 and 20% is due to the presence of a spacing agent in said backing layer.

4. A method according to claim 3 wherein said spacing agent is a starch ester containing hydrophobic groups.

5. A method according to claim 1 wherein said at least one N-containing polymer is gelatin.

6. A method according to claim 1 wherein said liquid black pigmented ink contains carbon black.

7. A method according to claim 6 wherein said carbon black is present in said ink in a concentration of at least 2% by weight.

8. A method according to claim 1 wherein said at least one grey ink is a pigmented ink containing carbon black in a lower concentration than in said pigmented black ink.

9. A method according to claim 1 wherein said at least one liquid grey ink contains a mixture of one or more cyan, magenta, and yellow colorants.

10. A method according to claim 1 wherein said at least one liquid black pigmented ink and said at least one liquid grey ink are aqueous inks.

11. A transparent receiver for ink jet printing comprising (i) a receiving layer containing a N-containing polymer, (ii) a transparent support, and (iii) a backing layer, characterized in that said transparent receiver exhibits a haze value between 10 and 20%, determined according to standard test ASTM D 1003.

12. A transparent receiver for ink jet printing according to claim 11 wherein said haze value between 10 and 20% is due to the presence of a spacing agent in said backing layer.

13. A transparent receiver for ink jet printing according to claim 12 wherein said spacing agent is an ester of starch comprising hydrophobic groups.

14. Use of the method for making a continuous tone image according to claim 1 for the reproduction of medical diagnostic information.

* * * * *